United States Patent [19]

Shishido

[11] 4,166,256

[45] Aug. 28, 1979

[54] ANTI MULTIPACTING RESONANT CAVITY

[75] Inventor: Tsuneo Shishido, Palos Verdes, Calif.

[73] Assignee: Hughes Aircraft Company, Culver City, Calif.

[21] Appl. No.: 757,127

[22] Filed: Jan. 5, 1977

[51] Int. Cl.[2] ..... H01P 1/20; H01P 1/00; H01P 7/06

[52] U.S. Cl. ..... 333/99 MP; 333/209; 333/231

[58] Field of Search ..... 333/99 MP, 83 R, 73 W

[56] References Cited

U.S. PATENT DOCUMENTS

| | | | |
|---|---|---|---|
| 3,748,604 | 7/1973 | Wang | 333/83 R |
| 4,053,855 | 10/1977 | Kivi et al. | 333/73 W |

*Primary Examiner*—Alfred E. Smith
*Assistant Examiner*—Harry E. Barlow
*Attorney, Agent, or Firm*—John Holtrichter, Jr.; W. H. MacAllister

[57] ABSTRACT

A resonant cavity such as a diplexer filter and a coaxial resonator, for example, wherein its interior resonant cavity structure is packed with a powdered polytetrafluoroethylene material to prevent arcing within the resonant cavity structure due to the multipacting phenomenon.

2 Claims, 3 Drawing Figures

ANTI MULTIPACTING RESONANT CAVITY

BACKGROUND OF THE INVENTION

The background of the invention will be set forth in two parts.

1. Field of the Invention

This invention relates to microwave tuned circuits, and more particularly to microwave resonant cavity structures.

2. Description of the Prior Art

Over the years, as higher and higher levels of RF energy have been generated at microwave frequencies, the problem of multipacting has become quite critical. Multipacting is an alternating current phenomenon most often brought about with conditions of relatively high RF power in a resonant cavity.

Under these conditions, a very high alternating field strength is set up in a confined volume representing a tuned resonance circuit. Here, any free electrons which happen to occupy this space will be strongly attached to a wall of the resonant structure where additional electrons will be "fired". Under this AC resonance condition, more and more free electrons will be produced from opposite walls of the cavity structure until an electron cloud is created. This is a classical secondary electron emission resonance phenomenon, and is the instigator of arcing within the resonant structure.

In the past, careful designing of the resonant cavity with respect to geometry less likely to provide arcing was utilized. However, with the now prevalent use of higher and higher RF powered resonant circuits being used in spacecraft, the problems have increased tremendously since molecular spacing, of air molecules, enters into the picture to enhance the possibilities of a secondary electron emission resonance phenomenon occurring. That is, in applications where continuous generation and/or amplification of relatively high RF microwave power is required as a spacecraft is launched and is subject to continuously decreasing air pressure, the molecular separation increases and may provide a critical condition where the molecules are at resonance within the cavity structure to enhance the electron cloud buildup and cause a spark to occur.

The standard "cure" in the past has been to seal the resonant structure so that the molecular separation remains constant in any pressure environment. However, this is costly in money, weight and bulk. It should, therefore, be evident that a resonant cavity system that was not subject to multipacting in any pressure environment and which does not require sealed and pressurized structures would constitute a significant advancement in the art.

SUMMARY OF THE INVENTION

In view of the foregoing factors and conditions characteristic of the prior art, it is a primary object of the present invention to provide a new and improved anti multipacting resonant cavity.

Another object of the present invention is to provide a relatively light weight and compact anti multipacting resonant cavity.

Still another object of the present invention is to provide a high RF power resonant cavity design that does not require a pressurized sealed construction in order to avoid arcing, even in a changing molecular density environment.

In accordance with the present invention, there is provided an anti multipacting resonant cavity having a resonant cavity with an interior resonant cavity structure and powdered polytetrafluoroethylene material is packed within the interior resonant cavity structure to prevent electron cloud formation.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawing in which like reference characters refer to like elements in the general views.

DESCRIPTION OF THE PREFERRED EMBODIMENTS

Figure 1:
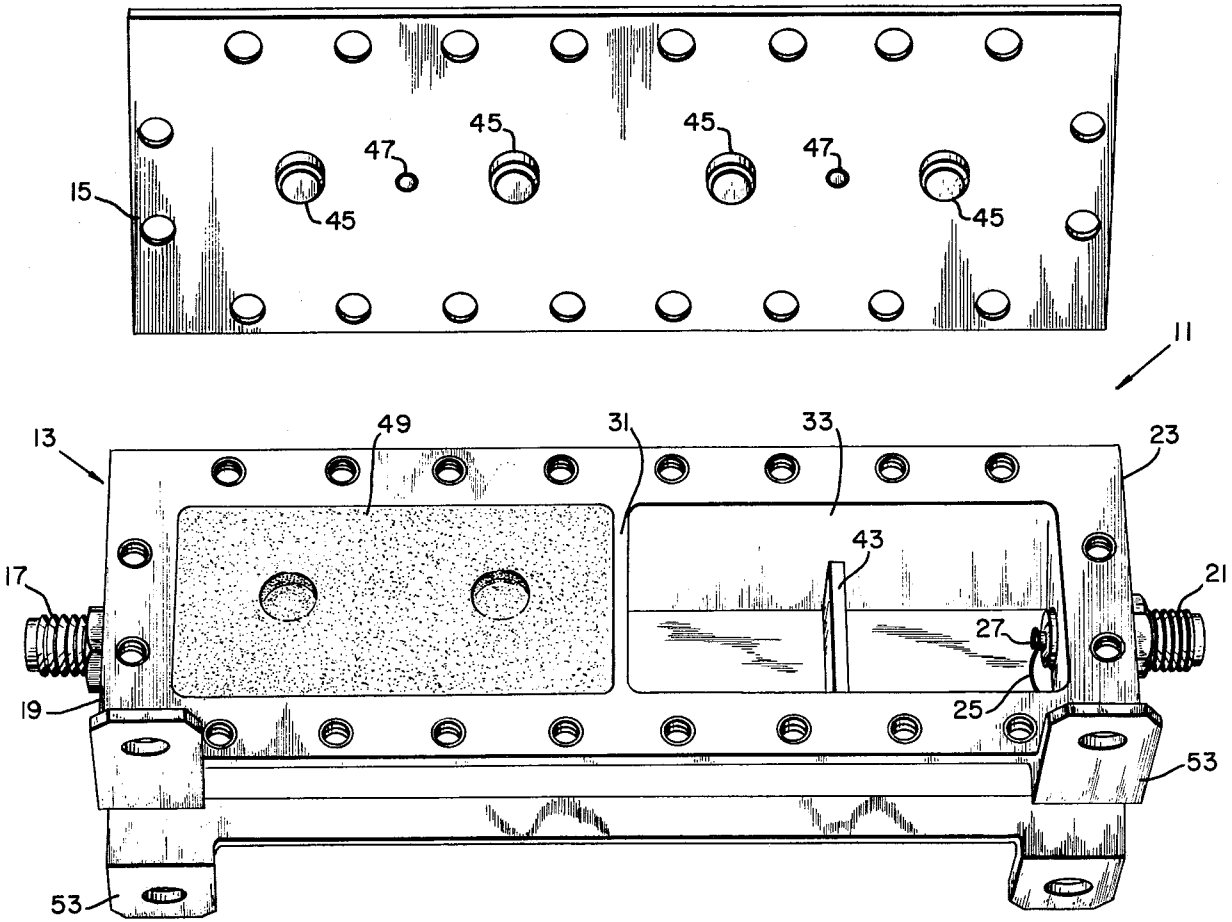
FIG. 1 is an elevational view of a resonant cavity structure with its cover removed and showing one section packed with a powdered polytetrafluoroethylene material in accordance with the invention.
Figure 2:
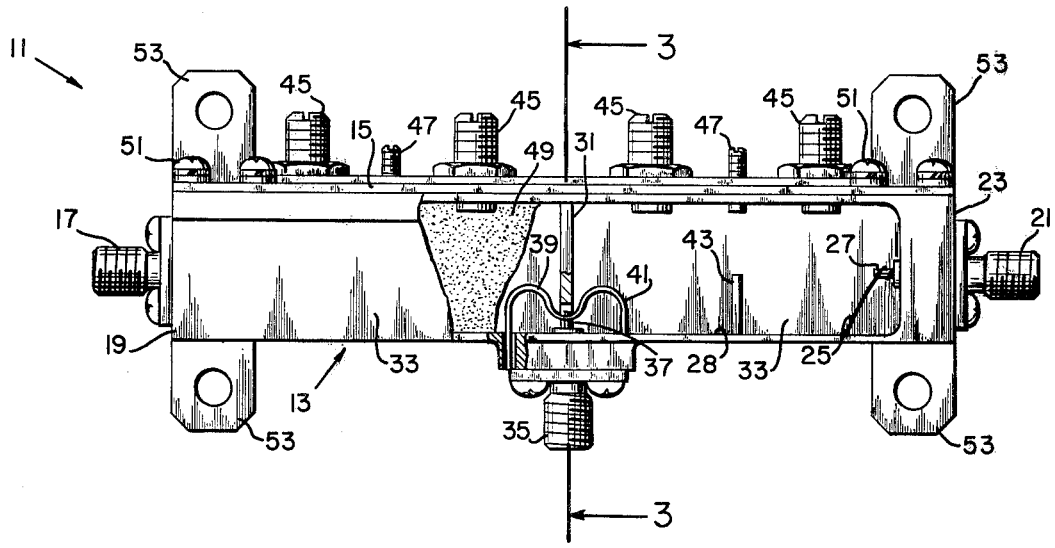
FIG. 2 is a side elevational view, in partial cross section, of the resonant cavity structure of FIG. 1.
Figure 3:
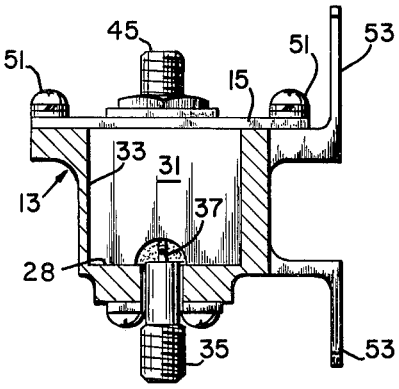
FIG. 3 is a sectional view of the resonant cavity structure taken along line 3—3 in FIG. 2.

Referring to the drawings, and more particularly to FIG. 1, there is shown a resonant cavity 11 having a cast housing 13 and a cover plate 15 temporarily removed to show the interior of the structure. In this example, the structure 11 is a diplexer filter having a first coaxial connector 17 centrally mounted in a first end wall 19 and a second coaxial connector 21 at a second end wall 23. Each of the coaxial connectors is provided with a conventional coupling loop 25 attached between a coaxial center conductor 27 of each connector and the bottom 28 of the casting, for coupling purposes.

The structure 11 is divided into two separate resonant cavity areas by a transverse wall 31 extending from the bottom 28 to the height of the filter's side walls 33. The lower portion of the wall 31 is notched out to accomodate a third coaxial connector 35 and its center conductor 37. Two coupling loops 39 and 41 are attached to the center conductor 37 but one disposed on different sides of the wall 31 so that energy is simultaneously coupled to or from these resonant cavity areas.

Also disposed in the structure are conventional resonator-defining septums 43, each resonator thus created being tuned by relatively large tuning screws 45 threadably engaged in appropriately threaded aperture in the cover plate 15. The plate 15 also carries relatively smaller conventional coupling screws 47 positioned in the plane of each of the septums 43.

In order not to require the pressurizing and sealing of the device in order to prevent arcing due to multipacting, at high RF field strength, especially when passing through critical altitudes, the cavities in the structure 11 are filled with a finely powdered polytetrafluoroethylene material 49 which is preferably packed therein to eliminate air pockets or voids. For the sake of illustration, only one of the cavities is shown filled with the powdered material 49. When both cavity areas are filled and packed, the cover plate 15 is firmly attached to the casting by means of screws 51. Flanges 53 are provided, in this embodiment, for mounting the structure 11 in a desired location.

The device so described may be used in space applications as a low loss telemetry diplexer, for example, for providing continuous tracking for a spacecraft from launch to a parking orbit without loss of signal while passing through the critical altitudes. This technique of filling a resonant cavity structure with a powdered polytetrafluoroethylene material also prevents arcing due to the use of high power in a partial or complete vacuum.

Although a diplexer has been specifically described in detail, it should be understood that other resonant cavity structures can be constructed or modified in accordance with the invention by filling the cavity areas with the powdered material 49. This material tends to adhere to itself and does not interfere with the use of the tuning and coupling screws, and does not modify the loading or tuning of the cavities by its use. It tests of the structure shown in the drawings, no significant energy loss could be detected.

From the foregoing, it should be evident that there has been described a very useful and advantageous anti multipacting resonant cavity that constitutes a significant advancement in the art. Additional design information for structures similar to the one herein described may be obtained by referring to a text entitled "Handbook of Filter Synthesis" by Anatol I. Zverec, John Wiley & Sons, N.Y., Chapter I, pp. 27 & 28, 1967.

What is claimed is:

1. An anti multipacting resonant cavity, comprising:

a resonant cavity having an interior resonant cavity structure; and a powdered polytetrafluoroethylene material packed within said interior resonant cavity structure, said interior resonant cavity structure includes adjustable tuning means extending therein, said tuning means being tunable after assembly in said interior resonant cavity structure.

2. A method of providing an anti multipacting resonant cavity having an interior resonant cavity structure, comprising the steps of:

packing a powdered polytetrafluoroethylene material within said interior resonant cavity structure, tuning said interior resonant cavity structure subsequent to said packing thereof with said powdered polytetrafluoroethylene material.

* * * * *